US010799947B2

(12) United States Patent
Zhao et al.

(10) Patent No.: US 10,799,947 B2
(45) Date of Patent: Oct. 13, 2020

(54) METHOD OF SEMI-SOLID INDIRECT SQUEEZE CASTING FOR MAGNESIUM-BASED COMPOSITE MATERIAL

(71) Applicant: NORTH UNIVERSITY OF CHINA, Shanxi Province, Taiyuan (CN)

(72) Inventors: Yuhong Zhao, Taiyuan (CN); Liwen Chen, Taiyuan (CN); Ting Zhang, Taiyuan (CN); Jianquan Liang, Taiyuan (CN); Hua Hou, Taiyuan (CN); Feng Yan, Taiyuan (CN); Muxi Li, Taiyuan (CN)

(73) Assignee: NORTH UNIVERSITY OF CHINA, Taiyuan (CN)

( * ) Notice: Subject to any disclaimer, the term of this patent is extended or adjusted under 35 U.S.C. 154(b) by 0 days.

(21) Appl. No.: 16/235,570

(22) Filed: Dec. 28, 2018

(65) Prior Publication Data

US 2020/0206808 A1 Jul. 2, 2020

(51) Int. Cl.
*B22D 18/02* (2006.01)
*B22D 21/00* (2006.01)
(Continued)

(52) U.S. Cl.
CPC ..... *B22D 18/02* (2013.01); *B22D 21/007* (2013.01); *C22C 1/02* (2013.01); *C22C 1/1036* (2013.01);
(Continued)

(58) Field of Classification Search
CPC ..... B22D 18/00; B22D 18/02; B22D 21/007; B22D 25/00; B22D 25/02; B22D 31/00; B22D 31/002
See application file for complete search history.

(56) References Cited

FOREIGN PATENT DOCUMENTS

CN 102212727 A * 10/2011
CN 102766791 A * 11/2012
CN 105220055 A * 1/2016

* cited by examiner

*Primary Examiner* — Kevin P Kerns
*Assistant Examiner* — Steven S Ha
(74) *Attorney, Agent, or Firm* — Law Offices of Steven W. Weinrieb

(57) ABSTRACT

The present invention relates to a method of semi-solid indirect squeeze casting for Mg-based composite material, which aims at improving the mechanical property of the cast by adding magnesium zinc yttrium quasicrystal of high hardness, high elastic modulus and excellent matrix binding property acting as the reinforcement into the magnesium alloy matrix and manufacturing the cast through smelting using a vacuum atmosphere smelting furnace, agitating with ultrasonic wave assisted vibration in the rotating impeller jet agitation furnace and indirect squeeze casting against the problem of poor wettability, easy agglomeration, inhomogeneous distribution between the reinforcement particles and the matrix materials and poor properties of the manufactured cast. The manufacturing method of the present invention has advanced technologies and detailed and accurate data. The cast has excellent microstructure compactness, no shrinkage cavities and shrinkage defects and the primary phase in the metallographic structure consists of spherical and near-spherical crystalline grains, wherein dendritic crystalline grains almost disappear and the size of the crystalline grain is obviously refined. The tensile strength of the Mg-based composite material cast reaches to 225 Mpa, the elongation rate thereof reaches to 6.5% and the hardness thereof reaches to 86 HV. So the manufacturing method of the present invention is an advanced semi-solid indirect squeeze casting method for the Mg-based composite material.

3 Claims, 3 Drawing Sheets

(51) Int. Cl.

| | |
|---|---|
| ***C22C 1/02*** | (2006.01) |
| ***C22C 1/10*** | (2006.01) |
| ***C22C 23/00*** | (2006.01) |

(52) U.S. Cl.
CPC ..... *C22C 23/00* (2013.01); *C22C 2001/1047* (2013.01)

METHOD OF SEMI-SOLID INDIRECT SQUEEZE CASTING FOR MAGNESIUM-BASED COMPOSITE MATERIAL

FIELD OF INVENTION

The present invention relates to a method of semi-solid indirect squeeze casting for Mg-based composite material and it pertains to the technical area of the preparation and application of the Non-ferrous metal.

BACKGROUND OF THE INVENTION

A magnesium alloy possesses excellent properties such as light weight, high specific strength and high specific stiffness, excellent thermal and electrical conductivity, excellent vibration damping, good electromagnetic shielding property and easy to be processed, molded and recycled, for which it is listed as high-end new materials. However, the magnesium alloy has problems such as low strength, poor anti-oxidation property and poor performance of high temperature creep resistance, which limit its further application in the industry. Therefore, it is very necessary to improve the comprehensive properties of the magnesium alloy and develop new type of Mg-based composite materials. At present, mostly adopted particles such as $Al_2O_3$, SiC, TiC, $SiO_2$ acting as the reinforcement are added into the magnesium alloy matrix to prepare the Mg-based composite material, however, added particles are easy to agglomerate and not evenly distributed in the matrix due to the poor wettability between the added particles and the magnesium alloy matrix. Meanwhile, as the interface reaction occurs between the additionally added particles and the magnesium alloy matrix and produces some harmful brittle phases, the properties of the composite materials are weakened.

The preparation of Mg-based composite materials generally adopts the agitation casting method in which agitation is done at liquid state. As the negative pressure produced during the agitation process makes the composite materials inhale air easily and then generate pores and the difference of density between the reinforced particles and matrix alloy can easily cause the sediment of particles and the agglomeration phenomenon of fine particles, which will generate second phase segregation, the reinforced particles cannot be evenly distributed within the matrix. As the molding temperature is high, defects such as contraction cavity and shrinkage may be easily caused inside of the molded cast, and then the mechanical property of the cast is weakened.

SUMMARY OF THE INVENTION

The target of the present invention aims at improving the mechanical property of the cast by adding magnesium zinc yttrium quasicrystal of high hardness, high elastic modulus and excellent matrix binding property acting as the reinforcement into the magnesium alloy matrix, smelting using a vacuum atmosphere smelting furnace and agitating assisted with ultrasonic vibration in the rotating impeller jet agitation furnace, and indirect squeeze casting to manufacture the Mg-based composite materials cast against shortage existing in the background.

Technical Solution

The chemical materials used in the present invention are: magnesium alloy, magnesium zinc yttrium quasicrystal, absolute ethanol, argon and magnesium oxide mold release agent, and the preparation dosages thereof in the unit of measurement of gram, milliliter, centimeter$^3$ are as follows:

| | | |
|---|---|---|
| magnesium alloy: AZ91D | Solid block | 20000 g ± 1 g |
| magnesium zinc yttrium quasicrystal: $Mg_3YZn_6$ | Solid block | 1200 g ± 1 g |
| absolute ethanol: $C_2H_5OH$ | Liquid liquor | 1000 mL ± 50 mL |
| argon: Ar | Gaseous gas | 1200000 cm$^3$ ± 100 cm$^3$ |
| magnesium oxide mold release agent | Liquid liquor | 350 mL ± 5 mL |
| graphite lubricant | Liquid liquor | 150 mL ± 5 Ml |

wherein the preparation method is as follows:

(1) manufacturing an indirect squeeze casting mold by using a hot forging mold steel and the surface roughness of the fixed mold cavity and movable mold cavity both are Ra 0.08-0.16 μm;

(2) pre-treating magnesium zinc yttrium quasicrystal ball milling, 1200 g±1 g magnesium zinc yttrium quasicrystal is added into the ball mill tank of a ball mill and ball milled into magnesium zinc yttrium quasicrystal fine powder, wherein the volume ratio of the milling ball to the powder is 3:1 and the milling time is 2.5 h;

(3) screening, filtering the magnesium zinc yttrium quasicrystal fine powder with 400 mesh sieve, which is then subjected to ball grinding and sifting repeatedly to produce the magnesium zinc yttrium quasicrystal powder;

(4) magnesium alloy dicing by putting 20000 g±1 g magnesium alloy on the steel plate and getting them diced with machines into blocks with a size ≤20 mm×40 mm×40 mm;

(5) smelting magnesium alloy melt by conducting the smelting in a vacuum atmosphere smelting furnace, and finishing by pre-heating, smelting under argon atmosphere and thermal insulation process;

(6) clearing the inside of the smelting crucible with a metal shovel and a metal brush to the make the surface clean and washing the internal surface of the smelting crucible with absolute ethanol to make it clean;

(7) pre-heating the magnesium alloy blocks by putting the diced magnesium alloy blocks into pre-heating furnace to conduct the pre-heating, for standby, wherein the pre-heating temperature is 155° C.;

(8) pre-heating the smelting crucible by turning on the vacuum atmosphere smelting furnace heater to pre-heat the smelting crucible, and turning off vacuum atmosphere smelting furnace heater after pre-heating 15 minutes, wherein the pre-heating temperature is 200° C.;

(9) putting the pre-heated magnesium alloy blocks into the pre-heated smelting crucible and obturating the vacuum atmosphere smelting furnace; turning on the vacuum pump of the vacuum atmosphere smelting furnace to drawing-off air within the furnace to allow a 2 Pa pressure within the furnace;

(10) turning on the vacuum atmosphere smelting furnace heater, when the temperature reaches to 250° C., feeding argon into the vacuum atmosphere smelting furnace at a feeding rate of 200 cm$^3$/min so as to maintain the pressure inside the furnace at one atmospheric pressure, which is regulated by the outlet pipe and the outlet valve of the vacuum atmosphere smelting furnace;

(11) continually heating and smelting the magnesium alloy, which is then thermally insulated for 15 minutes at a constant temperature, wherein the smelting temperature is 720° C.±1° C.;

(12) cooling the magnesium alloy to 690° C.±1° C. and thermally insulating it at a constant temperature for 10 minutes to produce the magnesium alloy melt;

(13) preparing semi-solid alloy melt of the Mg-based composite material by ultrasound-assisted rotating impeller jet agitation;

(14) sealing the rotating impeller jet agitation furnace and turning on the vacuum pump of the rotating impeller jet agitation furnace to draw-off air within the furnace, making a 2 Pa pressure within the furnace;

(15) turning on the rotating impeller jet agitation furnace heater and pre-heating the rotating impeller jet agitation crucible, wherein the pre-heating temperature is 300° C.;

(16) when the temperature reaches to 300° C., turning on the inlet valve of the rotating impeller jet agitation furnace to feed argon into the rotating impeller jet agitation furnace through the inlet pipe of the rotating impeller jet agitation furnace and maintaining the pressure within the furnace at one atmospheric pressure, which is regulated by the outlet pipe and the outlet valve of the rotating impeller jet agitation furnace, wherein the feeding rate of argon is 200 $cm^3$/min;

(17) turning on the electromagnetic pump of the vacuum atmosphere smelting furnace to pump the magnesium alloy melt into the rotating impeller jet agitation crucible through the feed pipe;

(18) adjusting the temperature within the rotating impeller jet agitation furnace to maintain the temperature at 570° C.±1° C., at which the magnesium alloy melt is thermally insulation for 6 minutes, then turning on and adjusting the controller of the rotating impeller jet agitation, device to maintain the rotational speed of 100 r/min, at which the magnesium alloy melt is thermostatically agitated for 10 minutes to produce the semi-solid alloy melt;

(19) turning on the ultrasonic vibration device and adjusting the ultrasonic frequency to be 90 kHz; adjusting the controller of the rotating impeller jet agitation device to maintain the rotational speed of 150 r/min, wherein the agitation time is 5 minutes;

(20) putting the magnesium zinc yttrium quasicrystal powder into the argon and quasicrystal mixing device and turning on the argon and quasicrystal mixture inlet pipe, adding argon mixed with quasicrystal particle into the semi-solid alloy melt through the rotating impeller jet agitation device;

(21) continually agitating for 8 minutes under the assistance of the ultrasonic vibration device;

(22) semi-solid indirect squeeze casting by pre-heating the indirect squeeze casting mold and the charging cylinder, wherein the pre-heating temperature of the indirect squeeze casting mold is 235° C. and the pre-heating temperature of the charging cylinder is 345° C.;

(23) uniformly spraying the magnesium oxide mold release agent on the surface of the mold cavity, wherein the thickness of the surface is 0.2 mm;

(24) injecting 150 mL graphite lubricant in the gap between the charging cylinder and the plunger chip to conduct the lubrication;

(25) turning off the rotating impeller jet agitation device and turning on the electromagnetic pump of the rotating impeller jet agitation furnace to transport the semi-solid alloy melt into the charging cylinder through the feed tube;

(26) clamping the indirect squeeze casting mold by pushing the semi solid alloy melt into the mold cavity through a runner with the plunger chip and sustaining pressure with the plunger chip, wherein an ejection speed of the plunger chip is 95 mm/s, a sustained pressure is 235 Mpa and a sustaining time is 15 s;

(27) opening mold and releasing mold, after which the plunger chip continues to move upward and ejects the cast;

(28) cooling the cast by placing the cast on the steel plate to be naturally cooled to 25° C.;

(29) clearing and washing the cast by cutting and molding the cast using a machine on the steel plate;

(30) clearing each part of the cast and the surrounding areas thereof and polishing the surface of the cast with 400 mesh sand paper, and then it is washed with absolute ethanol and then dried in the air;

(31) testing, analysis and characterization by conducting testing, analysis and characterization on the morphology, color, metallographic structure and mechanical property of the cast;

(32) conducting the metallographic analysis with a metallographic microscopy;

(33) conducting the diffraction intensity analysis with X ray diffractometer;

(34) conducting the tensile strength and elongation analysis with an electronic universal testing machine; and

(35) conducting the hardness analysis with a Vickers hardness tester.

The conclusion is that the Mg-based composite material cast has excellent microstructure (metallographic structure) compactness, no shrinkage cavities and shrinkage defects. The primary phase in the metallographic structure consists of spherical and near-spherical crystalline grains and dendritic crystalline grains almost disappear, the size of the crystalline grain is obviously refined. The tensile strength of the Mg-based composite material cast reaches to 225 Mpa, the elongation rate thereof reaches to 6.5% and the hardness thereof reaches to 86 HV.

Beneficial Effects

Compared with the background art, the present invention present obvious advancement and aims at improving the mechanical property of the cast by adding magnesium zinc yttrium quasicrystal of high hardness, high elastic modulus and excellent matrix binding property acting as the reinforcement into the magnesium alloy matrix and manufacturing the cast through smelting using a vacuum atmosphere smelting furnace, agitating with ultrasonic wave assisted vibration in the rotating impeller jet agitation furnace and indirect squeeze casting against the problem of poor wettability, easy agglomeration and inhomogeneous distribution between the reinforcement particles and the matrix materials, and poor properties of the manufactured cast. The manufacturing method of the present invention has advanced technologies and detailed and accurate data. The cast has excellent microstructure compactness, no shrinkage cavities and shrinkage defects and the primary phase in the metallographic structure consists of spherical and near-spherical crystalline grains, wherein dendritic crystalline grains almost disappear and the size of the crystalline grain is obviously refined. The tensile strength of the Mg-based composite material cast reaches to 225 Mpa, the elongation rate thereof reaches to 6.5% and the hardness thereof reaches to 86 HV. So the manufacturing method of the present invention is an advanced method of semi-solid indirectly extrusion casting molding of the Mg-based composite material.

DETAILED DESCRIPTION OF THE INVENTION

As shown in the figures, marks for the figures are listed as follow: 1. overall control cabinet; 2. vacuum atmosphere smelting furnace; 3. rotating impeller jet agitation furnace; 4. electromagnetic pump of the vacuum atmosphere smelting furnace; 5. electromagnetic pump of the rotating impeller jet agitation furnace; 6. rotating impeller jet agitation device; 7. controller of the rotating impeller jet agitation device; 8. first argon cylinder; 9. second argon cylinder; 10. inlet pipe of the vacuum atmosphere smelting furnace; 11. inlet valve of the vacuum atmosphere smelting furnace; 12. outlet pipe of the vacuum atmosphere smelting furnace; 13. outlet valve of the vacuum atmosphere smelting furnace; 14. inlet pipe of the rotating impeller jet agitation furnace; 15. inlet valve of the rotating impeller jet agitation furnace; 16. outlet pipe of the rotating impeller jet agitation furnace; 17. outlet valve of the rotating impeller jet agitation furnace; 18. first cable; 19. second cable; 20. third cable; 21. smelting crucible; 22. vacuum atmosphere smelting furnace heater; 23. vacuum pump of the vacuum atmosphere smelting furnace; 24. magnesium alloy melt; 25. feed pipe; 26. insulation sleeve of the feed pipe; 27. rotating impeller jet agitation crucible; 28. rotating impeller jet agitation furnace heater; 29. vacuum pump of the rotating impeller jet agitation furnace; 30. ultrasonic vibration device; 31. semi-solid alloy melt; 32. argon; 33. feed tube; 34. argon and quasicrystal mixing device; 35. agitation motor; 36. transmission; 37. rotating joint; 38. argon and quasicrystal mixture inlet pipe; 39. movable mold back plate; 40. movable mold; 41. fixed mold; 42. first mold rack; 43. second mold rack; 44. third mold rack; 45. fourth mold rack; 46. charging cylinder; 47. heating insulation sleeve of the charging cylinder; 48. temperature measuring equipment of the charging cylinder; 49. plunger chip; 50. plunger rod; 51. cast.

Figure 1:
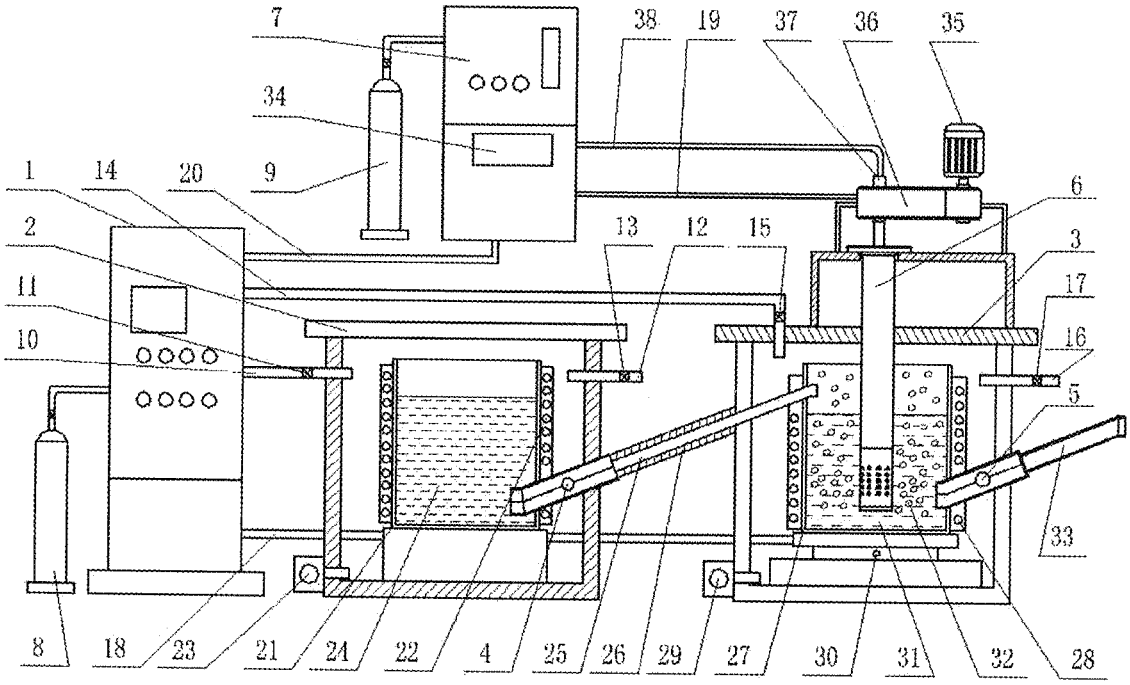
FIG. 1 is the state diagram of preparing the semi-solid alloy melt of the Mg-based composite materials.

Now the present invention will be further described in combination with the figures:

FIG. 1 shows the state diagram of preparing the semi-solid alloy melt of the Mg-based composite materials, wherein the location of each part and the connection relationship need to be correct so that the installation is secured;

A complete preparation device mainly consists of overall control cabinet 1, vacuum atmosphere smelting furnace 2, rotating impeller jet agitation furnace 3, electromagnetic pump of the vacuum atmosphere smelting furnace 4, electromagnetic pump of the rotating impeller jet agitation furnace 5, rotating impeller jet agitation device 6 and controller of the rotating impeller jet agitation device 7.

The overall control cabinet 1 controls the operation state of vacuum atmosphere smelting furnace 2, rotating impeller jet agitation furnace 3, electromagnetic pump of the vacuum atmosphere smelting furnace 4, electromagnetic pump of the rotating impeller jet agitation furnace 5, vacuum pump of the vacuum atmosphere smelting furnace 23 and vacuum pump of the rotating impeller jet agitation furnace 29 through the first cable 18. The left side of the overall control cabinet 1 is connected to the first argon cylinder 8 and the overall control cabinet 1 is connected to vacuum atmosphere smelting furnace 2 through the inlet pipe of vacuum atmosphere smelting furnace 10 and inlet valve of the vacuum atmosphere smelting furnace 11. The vacuum atmosphere smelting furnace 2 adjusts the pressure within the furnace through the outlet pipe of the vacuum atmosphere smelting furnace 12 and the outlet valve of the vacuum atmosphere smelting furnace 13. The overall control cabinet 1 is connected to the rotating impeller jet agitation 3 through inlet pipe of the rotating impeller jet agitation furnace 14 and inlet valve of the rotating impeller jet agitation furnace 15. The rotating impeller jet agitation furnace 3 adjusts the pressure within the furnace through outlet pipe of the rotating impeller jet agitation furnace 16 and outlet valve of the rotating impeller jet agitation furnace 17.

The magnesium alloy melt 24 is smelted in the smelting crucible 21 of the vacuum atmosphere smelting furnace 2. Around the smelting crucible 21, it is configured with vacuum atmosphere smelting furnace heater 22. The vacuum atmosphere smelting furnace 2 is connected to the rotating impeller jet agitation furnace 3 through electromagnetic pump of the vacuum atmosphere smelting furnace 4 and feed pipe 25. Outside of the feed pipe 25, it is configured with insulation sleeve of the feed pipe 26. By turning on the electromagnetic pump of the vacuum atmosphere smelting furnace 4, the magnesium alloy liquid 24 can be pumped to the rotating impeller jet agitation crucible 27 of the rotating impeller jet agitation furnace 3 through the feed pipe 25.

Around the rotating impeller jet agitation crucible 27, rotating impeller jet agitation furnace heater 28 is configured. In the lower part of the rotating impeller jet agitation crucible 27, the ultrasonic vibration device 30 is configured. The agitation end of the rotating impeller jet agitation n device 6 is arranged in the semi-solid alloy melt 31 within the rotating impeller jet agitation crucible 27.

The rotating impeller jet agitation device 6 is powered by the agitation motor 35 and the agitation motor 35 is connected to the rotating impeller jet agitation device 6 through the transmission 36. The controller of the jet spouting agitation device 7 controls the operation state of the rotating impeller jet agitation device 6 through the second cable 19 and is connected to the overall control cabinet 1 through the third cable 20.

The left side of the controller of the rotating impeller jet agitation device 7 is connected to the second argon cylinder 9. The controller of the rotating impeller jet agitation device 7 is configured with the argon and quasicrystal mixing device 34 which is connected to the rotating impeller jet agitation device 6 through the argon and quasicrystal mixture inlet pipe 38 and the rotating joint 37. Argon 32 mixed with quasicrystal powder is feed into the semi-solid alloy melt 31 through the argon and quasicrystal mixture inlet pipe 38, the rotating joint 37 and rotating impeller jet agitation device 6. The ultrasonic vibration device 30 assists argon 32 in the semi-solid alloy melt 31 to be discharged.

The rotating impeller jet agitation crucible 27 is connected to the electromagnetic pump of the rotating impeller jet agitation furnace 5. The semi-solid alloy melt 31 is transported to the material cylinder 46 through the electromagnetic pump of the rotating impeller jet agitation furnace 5 and the feed tube 33.

Figure 2:
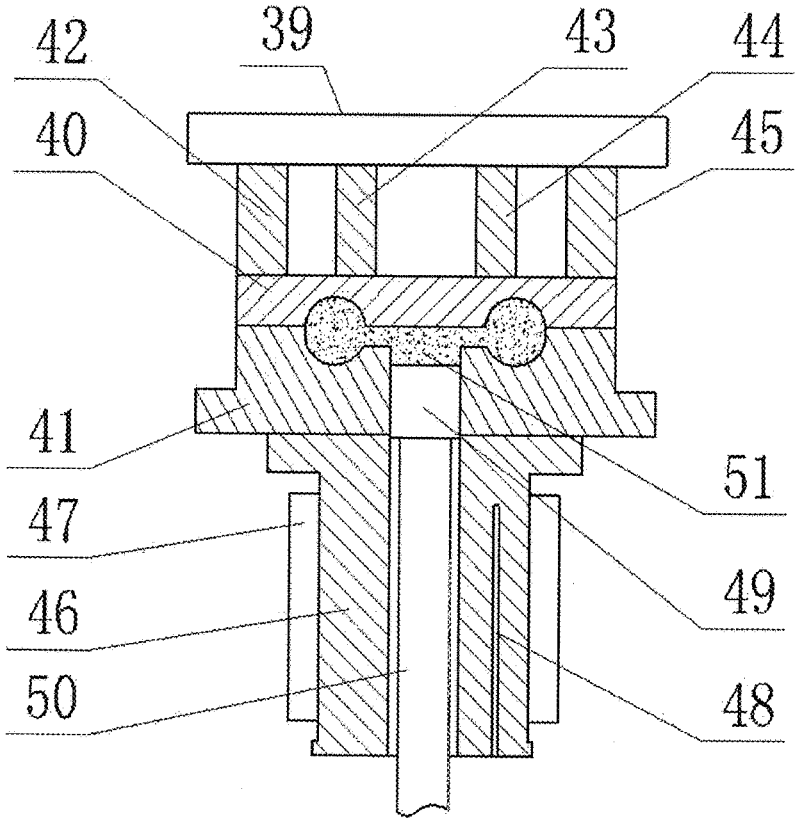
FIG. 2 is the state diagram showing the semi-solid alloy melt filling the mold cavity and the plunger chip sustaining pressure.

FIG. 2 shows the state diagram showing the semi-solid alloy melt filling the mold cavity and the plunger chip sustaining pressure. The plunger rod 50 pushes the plunger chip 49 to move upwardly and the plunger chip 49 pushes the semi-solid alloy melt into the mold cavity, and then the plunger chip 49 maintains the pressure to produce the cast 51.

Figure 3:
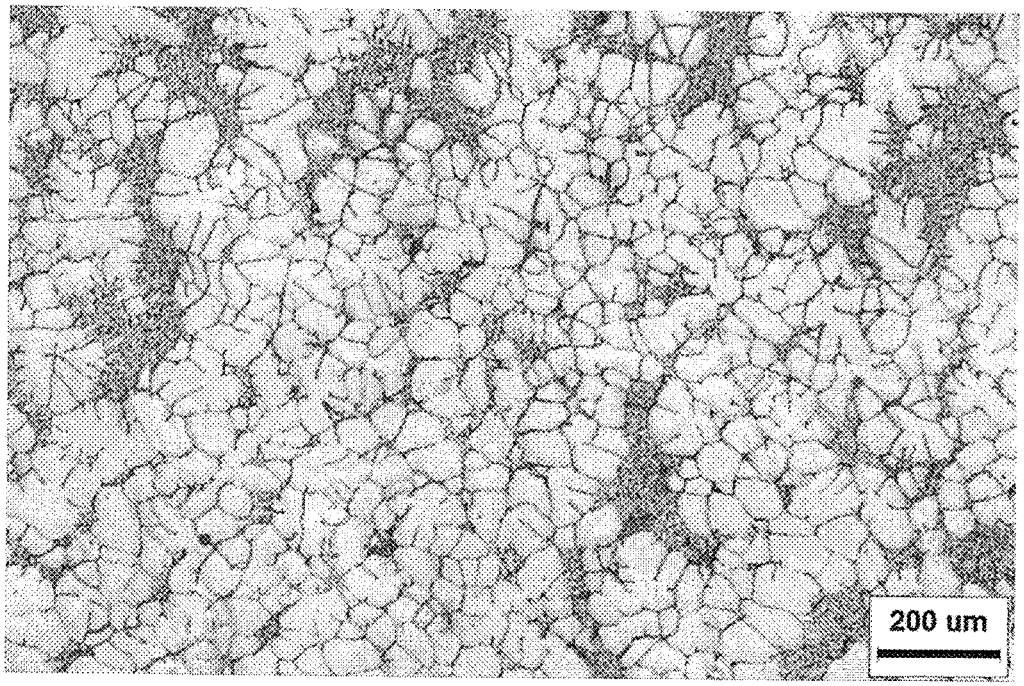
FIG. 3 is the metallographic structure diagram in the internal of cast.

FIG. 3 shows the metallographic structure image of casting internal. As shown in the figure, the cast has excellent microstructure compactness, no shrinkage cavities and shrinkage defects and the primary phase in the metallographic structure consists of spherical and near-spherical crystalline grains, wherein dendritic crystalline grains almost disappear and the size of the crystalline grain is obviously refined.

Figure 4:
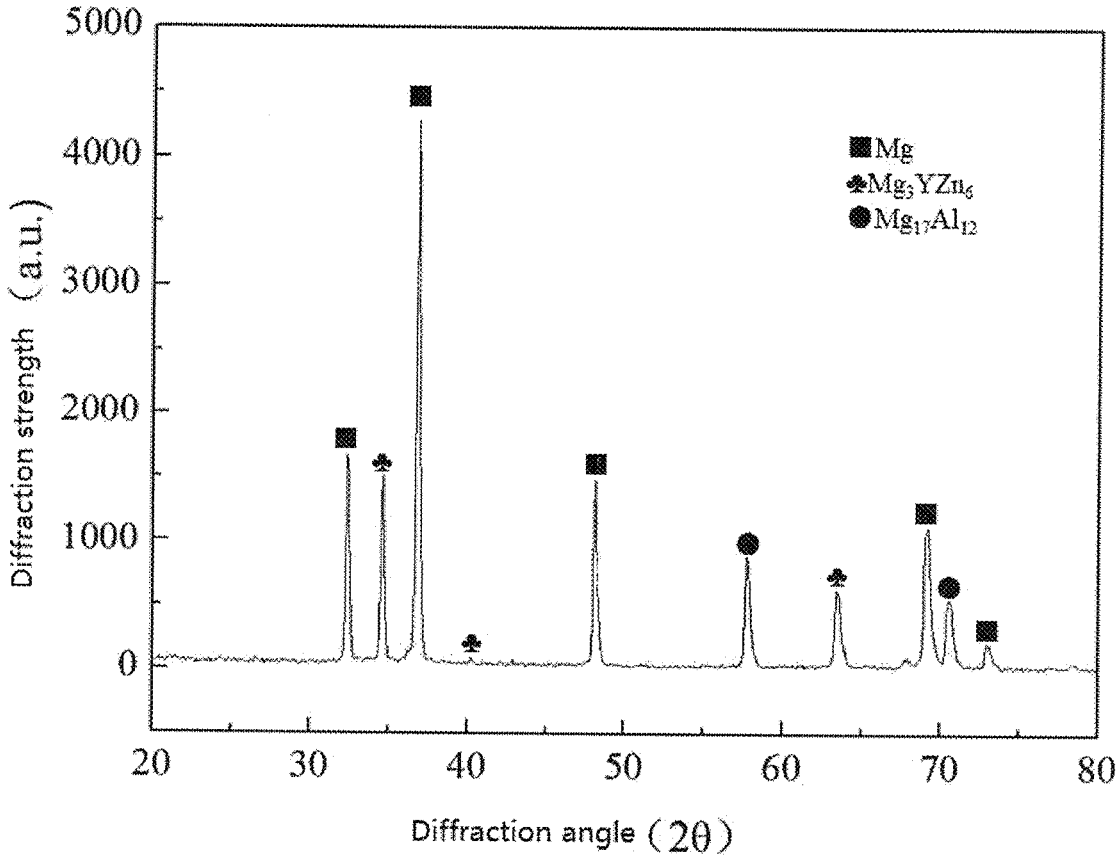
FIG. 4 is the X ray diffraction strength map of the Mg-based composite materials.

FIG. 4 shows the X ray diffraction strength map of the Mg-based composite materials. As shown in the figure, Mg phase, qusicrystal phase $Mg_3YZn_6$ and $Mg_{17}Al_{12}$ phase exist in the internal of the Mg-based composite material.

The invention claimed is:

1. A method of semi-solid indirect squeeze casting for a Mg-based composite material, wherein the used chemical materials are a magnesium alloy, magnesium zinc yttrium quasicrystal, absolute ethanol, argon and magnesium oxide mold release agent, and wherein the preparation dosages thereof are Solid magnesium alloy AZ91D 20000 g±1 g Solid magnesium zinc yttrium quasicrystal: $Mg_3Yzn_6$ powder 1200 g±1 g absolute ethanol: $C_2H_5OH$ 1000 ml±50 ml argon gas: Ar 1200000 $cm^3$±100 $cm^3$ magnesium oxide mold release agent 350 ml±5 ml graphite lubricant 150 ml±5 ml and wherein the method comprises the steps of:

manufacturing an indirect squeeze casting mold wherein said indirect squeeze casting mold is made by using a hot forging mold steel wherein the surface roughness of a fixed mold cavity and a movable mold cavity of said indirect squeeze casting mold are all both Ra 0.08-0.16 μm;

pre-treating said magnesium zinc yttrium quasicrystal by ball milling, wherein 1200 g±1 g magnesium zinc yttrium quasicrystal is added into a ball mill tank of a ball mill and a ball is milled into magnesium zinc yttrium quasicrystal fine powder, wherein the volume ratio of said milled ball to said powder is 3:1, and wherein the ball milling time is 2.5 h;

screening and filtering said magnesium zinc yttrium quasicrystal fine powder with a 400 mesh sieve, and ball grinding and sifting repeatedly so as to produce said magnesium zinc yttrium quasicrystal powder;

placing said magnesium alloy by putting 20000 g±1 g of said magnesium alloy onto a steel plate and dicing said magnesium alloy with machines into blocks having a size of ≤20 mm×40 mm×40 mm;

smelting a magnesium alloy melt by conducting a magnesium alloy melt into a vacuum atmosphere smelting furnace, smelting said magnesium alloy melt within an argon atmosphere while maintaining the temperature constant, and finishing said smelting by a preheating process;

clearing a smelting crucible by clearing an interior portion of said smelting crucible with a metal shovel and a metal brush so as to render said interior portion of said smelting crucible clear of debris, and washing said interior portion of said smelting crucible with absolute ethanol so as to render said interior portion of said smelting crucible clean;

preheating said diced magnesium alloy blocks by placing said diced magnesium alloy blocks into a preheating furnace having a predetermined preheating temperature of 155° C. so as to render said diced magnesium alloy blocks preheated;

preheating said smelting crucible by turning on a furnace heater of said vacuum atmosphere smelting furnace so as to preheat said smelting crucible disposed within said vacuum atmosphere smelting furnace, and subsequently turning off said furnace heater of said vacuum atmosphere smelting furnace after preheating said smelting crucible for 15 minutes at a preheating temperature of 200° C.;

placing said preheated magnesium alloy blocks into said pre-heated smelting crucible and sealing said vacuum atmosphere smelting furnace;

turning on a vacuum pump operatively connected to said vacuum atmosphere smelting furnace so as to create an atmosphere having an atmospheric pressure of 2 Pa within said vacuum atmosphere smelting furnace;

turning on said furnace heater of said vacuum atmosphere smelting furnace such that said vacuum atmosphere smelting furnace attains a temperature level of 250° C., and feeding argon gas into said vacuum atmosphere smelting furnace at a feed rate of 200 $cm^3$/min so as to maintain said atmospheric pressure within said vacuum atmosphere smelting furnace at one atmospheric pressure, which is regulated by an outlet pipe and an outlet valve of said vacuum atmosphere smelting furnace;

continually heating and smelting said magnesium alloy within said vacuum atmosphere smelting furnace, which is thermally insulated for 15 minutes at a constant temperature, wherein said smelting temperature is 720° C.±1° C.;

cooling said magnesium alloy to 690° C.±1° C. and thermally insulating said magnesium alloy so as to maintain said magnesium alloy at a constant temperature for 10 minutes so as to produce a magnesium alloy melt;

preparing a semi-solid alloy melt of a Mg-based composite material by ultrasound-assisted rotating impeller jet agitation;

sealing a rotating impeller jet agitation furnace and turning on a vacuum pump of said rotating impeller jet agitation furnace so as to create an atmosphere having an atmospheric pressure of a 2 Pa within said rotating impeller jet agitation furnace;

turning on a heater disposed within said rotating impeller jet agitation furnace so as to preheat a rotating impeller jet agitation crucible, disposed within said rotating impeller jet agitation furnace, to a temperature level of 300° C.;

when said temperature of said rotating impeller jet agitation crucible reaches 300° C., an inlet valve of said rotating impeller jet agitation furnace is opened so as to feed argon gas into said rotating impeller jet agitation furnace, at a feed rate of 200 $cm^3$/min, through an inlet pipe of said rotating impeller jet agitation furnace, wherein pressure within said rotating impeller jet agitation furnace is regulated and maintained at one atmospheric pressure by an outlet pipe and and an outlet valve of said rotating impeller jet agitation furnace;

turning on an electromagnetic pump of said vacuum atmosphere smelting furnace so as to pump said magnesium alloy melt through a feed pipe and into said rotating impeller jet agitation crucible of said rotating impeller jet agitation furnace;

adjusting the temperature within said rotating impeller jet agitation furnace so as to maintain said temperature within said rotating impeller jet agitation furnace at 570° C.-±1° C., at which said magnesium alloy melt is thermally insulated for 6 minutes, then turning on and adjusting a controller of a rotating impeller jet agitation device so as to maintain the rotational speed of said rotating impeller agitation device at 100 rpm, at which time said magnesium alloy melt is thermostatically agitated for 10 minutes so as to produce said semi-solid alloy melt;

turning on an ultrasonic vibration device and adjusting the ultrasonic frequency to be 90 kHz;

adjusting said controller of said rotating impeller jet agitation device so as to maintain said rotational speed of 150 rpm for a predetermined time of 5 minutes;

putting said magnesium zinc yttrium quasicrystal powder into an argon gas and quasicrystal mixing device, opening an argon gas and quasicrystal mixture inlet pipe, and adding argon gas mixed with quasicrystal into said semi-solid alloy melt by said rotating impeller jet agitation device;

continually agitating said magnesium zinc yttrium quasicrystal powder and argon gas for 8 minutes by said ultrasonic vibration device;

semi-solid indirect squeeze casting by pre-heating an indirect squeeze casting mold and a charging cylinder, wherein a predetermined pre-heating temperature of said indirect squeeze casting mold is 235° C. and a predetermined pre-heating temperature of said charging cylinder is 345° C.;

uniformly spraying a magnesium oxide mold release agent onto a surface portion of a mold cavity, wherein a thickness dimension of said magnesium oxide mold release agent upon said surface portion of said mold cavity is 0.2 mm;

injecting 150 mL graphite lubricant into a gap defined between said charging cylinder and a plunger chip so as to conduct the achieve lubrication between said charging cylinder and said plunger chip;

turning off said rotating impeller jet agitation device and turning on said electromagnetic pump of said rotating impeller jet agitation furnace so as to transport said semi-solid alloy melt into said charging cylinder through a feed tube;

clamping said indirect squeeze casting mold, pushing said semi-solid alloy melt into said mold cavity through a runner with said plunger chip, and sustaining a predetermined pressure with said plunger chip, wherein an ejection speed of said plunger chip is 95 mm/s, a sustained pressure is 235 Mpa, and a sustained time is 15 s;

releasing said clamping of said indirect squeeze casting mold and opening said indirect squeeze casting mold so as to permit said plunger chip to continue to move upwardly and thereby eject the molded cast;

cooling said molded cast by placing said molded cast union a steel plate so as to be naturally cooled to 25° C.;

clearing said molded cast of any debris and washing said molded cast by cutting and forming said molded cast using a machine upon said steel plate;

clearing each part of said molded cast and all peripheral areas thereof, polishing all surfaces of said molded cast with 400 mesh sand paper, washing said molded cast with absolute ethanol, and then drying said molded cast in ambient air;

conducting testing and analysis of the morphology, color, metallographic structure, and mechanical properties of said molded cast;

conducting said metallographic analysis with a metallographic microscopy;

conducting diffraction intensity analysis with an X ray diffractometer;

conducting tensile strength and elongation analysis with an electronic universal testing machine; and conducting hardness analysis with a Vickers hardness tester.

2. The method of semi-solid indirect squeeze casting for Mg-based composite material according to claim 1, wherein:

said Mg-based composite material cast has no shrinkage cavities and no shrinkage defects; a primary phase in said metallographic structure consists of spherical crystalline grains and dendritic crystalline grains disappear, and the size of the crystalline grain is refined; and said tensile strength of said Mg-based composite material cast is 225 Mpa, an elongation rate of said Mg-based composite is 6.5% and said hardness of said Mg-based composite is 86 HV.

3. The method of semi-solid indirect squeeze casting for Mg-based composite material according to claim 1, wherein:

said molded cast has no shrinkage cavities and no shrinkage defects; a primary phase in said metallographic structure consists of spherical crystalline grains; wherein dendritic crystalline grains disappear; the size of said crystalline grain is refined; and an Mg phase, a quasicrystal phase $Mg_3YZN_6$, and an $Mg_{17}Al_{12}$ phase exist internally within said Mg-based composite material.

* * * * *